US008253001B1

(12) United States Patent
Liu

(10) Patent No.: US 8,253,001 B1
(45) Date of Patent: Aug. 28, 2012

(54) STRUCTURE OF DRUM WITH MULTIPLE USES

(75) Inventor: Mi-Kuei Liu, Taichung (TW)

(73) Assignee: Supreme Terra Co., Ltd., Taichung City (TW)

( * ) Notice: Subject to any disclaimer, the term of this patent is extended or adjusted under 35 U.S.C. 154(b) by 0 days.

(21) Appl. No.: 13/208,342

(22) Filed: Aug. 12, 2011

(51) Int. Cl.
*G10D 13/02* (2006.01)

(52) U.S. Cl. ..... 84/411 R

(58) Field of Classification Search ..... 84/411 R, 84/421, 417, 419, 420, 416, 411 P
See application file for complete search history.

(56) References Cited

U.S. PATENT DOCUMENTS 5,531,148 A * 7/1996 Wilson ..... 84/412
5,892,168 A * 4/1999 Donohoe ..... 84/411 M

* cited by examiner

*Primary Examiner* — Kimberly Lockett
(74) *Attorney, Agent, or Firm* — Leong C. Lei

(57) ABSTRACT

A structure of drum with multiple uses allows of being switched among multiple uses. The drum includes a shell which receives therein a slidable base board that carries thereon a multi-layered stack of cushioning pads and a detection sound collection board. The base board has opposite sides that are supported by slidable rod seats coupled to adjustable threaded rod, so that through rotation and adjustment of the threaded rods, upward movement of the base board is achieved to have the cushioning pad in contact engagement with a drum skin that reduces the sound generated by the drum so that the drum may serve as a practicing drum. Alternatively, the sound collection board is electrically connected to the electronic speaker, so that through controlled realized with a detection circuit board, an electronic drum is formed. For regular performance, the base board is separated from the skin to provide a regular drum.

6 Claims, 5 Drawing Sheets

STRUCTURE OF DRUM WITH MULTIPLE USES

TECHNICAL FIELD OF THE INVENTION

The present invention relates to an improved structure of drum with multiple uses, which comprises a drum shell receiving therein a vertically position adjustable slidable base board that is controllable with adjustable threaded rods arranged outside circumference, the base board carrying thereon a stacked arrangement of a sound collection board comprising a detection circuit board and cushioning pads that are vertically movable with the base board to have the cushioning pad engaging a drum skin and preventing the skin from generating sharp and high sound for serving as a practicing drum and selectively in electrical connection with an electronic speaker to serve as an electronic drum or to have the base board separated from the position engaging the skin so as to serve as a regular drum, whereby a single drum provides multiple uses that are selectively switchable.

DESCRIPTION OF THE PRIOR ART

A conventional drum is structured for a single function of use. In other words, for different purposes or use of percussion, the drums are made in different structures. A drum usually comprises a hollow shell as a major portion to which upper-side and lower-side skin or head is mounted by being secured by counterhoops to realize a sound structure of retaining for the drum. The operation of the drum is done by striking the skin that generates sound through the hollow shell. A drum player must practice drum percussion very often in order to gain skills of drum percussion. Apparently, regular practicing is important. Conventionally, practicing drum striking required s sound isolated and sound absorbing space, and this makes the practicing very inconvenient. With the increased population of drum lover, a practicing drum is available in the market, which comprises an improvement of or an accessory attached to the skin to reduce the sound so generated. However, additional expenses are required for purchasing the accessory or modifying the drum. On the other hand, such a modified drum is actually different from a drum for performance. This causes a problem of player's adaptation. In addition, to match the special requirement and sound effect for special performances, electronic drums gradually replace the regular drums. Such drums are of a structure that is totally different from the regular drums. All these conditions indicate that the development of drum becomes very versatile. It is thus desired to provide a structure of drum that can be selectively used as a regular drum, a practicing drum, and an electronic drum. Apparently, in respect of the development and improvement of drum structure, there is a great space for further improvement in order to meet the needs for different uses.

SUMMARY OF THE INVENTION

In view of the problems of inconvenience of drum percussion of the conventional drums, the present invention aims to provide an improved structure of drum with multiple uses, which comprises a hollow shell receiving therein a vertically slidable and controllable base board, which carries thereon a stacked arrangement of a sound collection board to which an electronic sound collection circuit board is mounted and cushioning pads, whereby with the vertical movement of the base board, contact engagement between a drum skin and the cushioning pad can be realized to allow the drum to serve as a practicing drum or an electronic drum with electrical power properly supplied thereto. As such, switchability between different modes of using the drum can be realized and the drawback of the conventional drum that is of a single function of use and thus impractical can be improved.

The primary objective of the present invention is to provide a drum that comprises a shell that receives therein a slidable and position adjustable base board. The base board carries thereon a sequentially stacked arrangement of an electronic sound collection board and cushioning pads. Through adjustable threaded rods that are arranged at opposite sides, adjustment of the base board for upward movement as desired can be done to bring the cushioning pad into contact engagement with the skin so as to provide a use as a practicing drum and through additionally connecting the sound collection board to an external electronic speaker and properly supplying of electrical power, a use as an electronic drum can be provided. Through a rotation operation that moves down the base board, the pads are separated from contact engagement with the skin in order to have the drum serve as a regular drum. As such a single drum can be of multiple switchable uses through position adjustment of a base board arranged in the drum.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
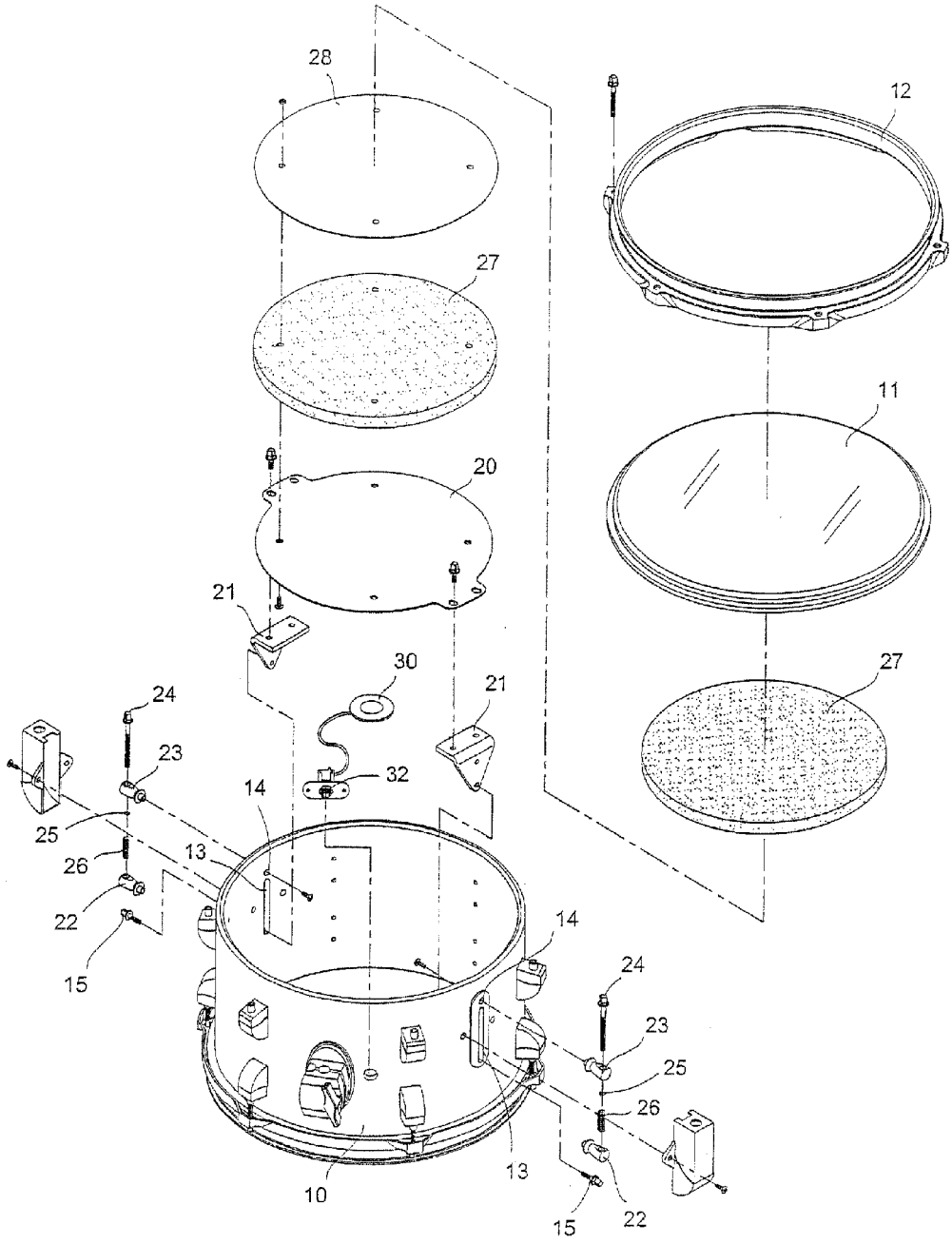
FIG. 1 is an exploded view of a drum constructed in accordance with the present invention.
Figure 2:
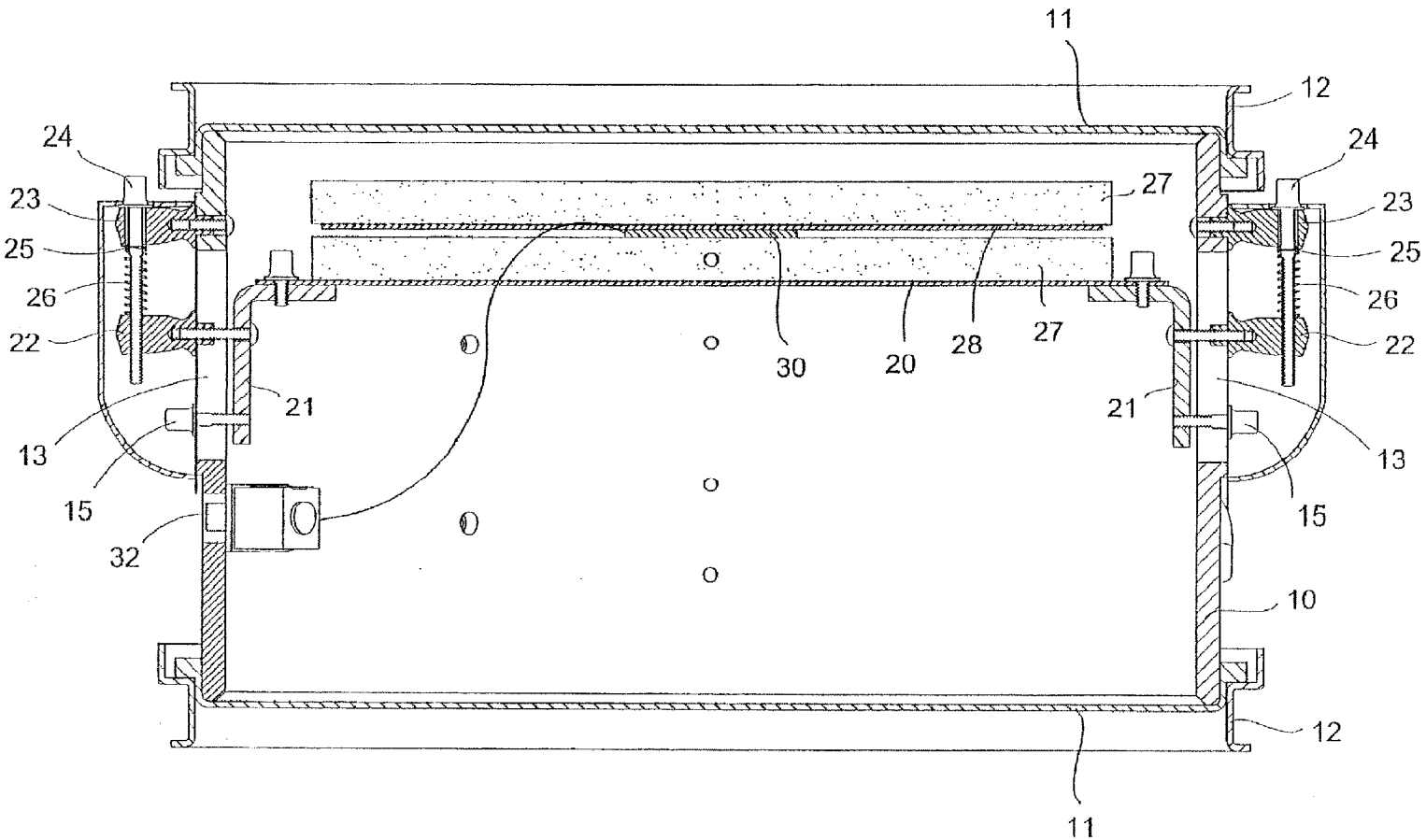
FIG. 2 is a cross-sectional view illustrating the drum of the present invention in a condition for regular use.
Figure 3:
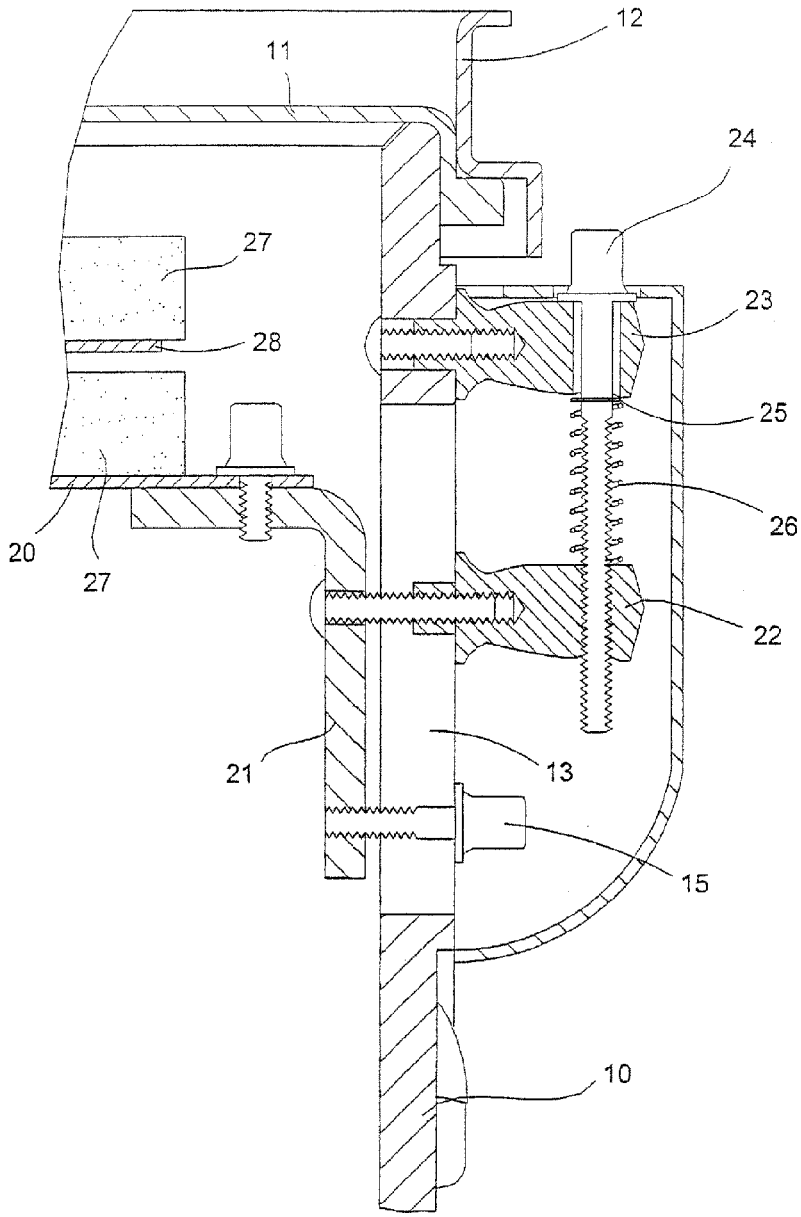
FIG. 3 is an enlarged view illustrating retaining and adjusting structure of the drum according to the present invention.
Figure 4:
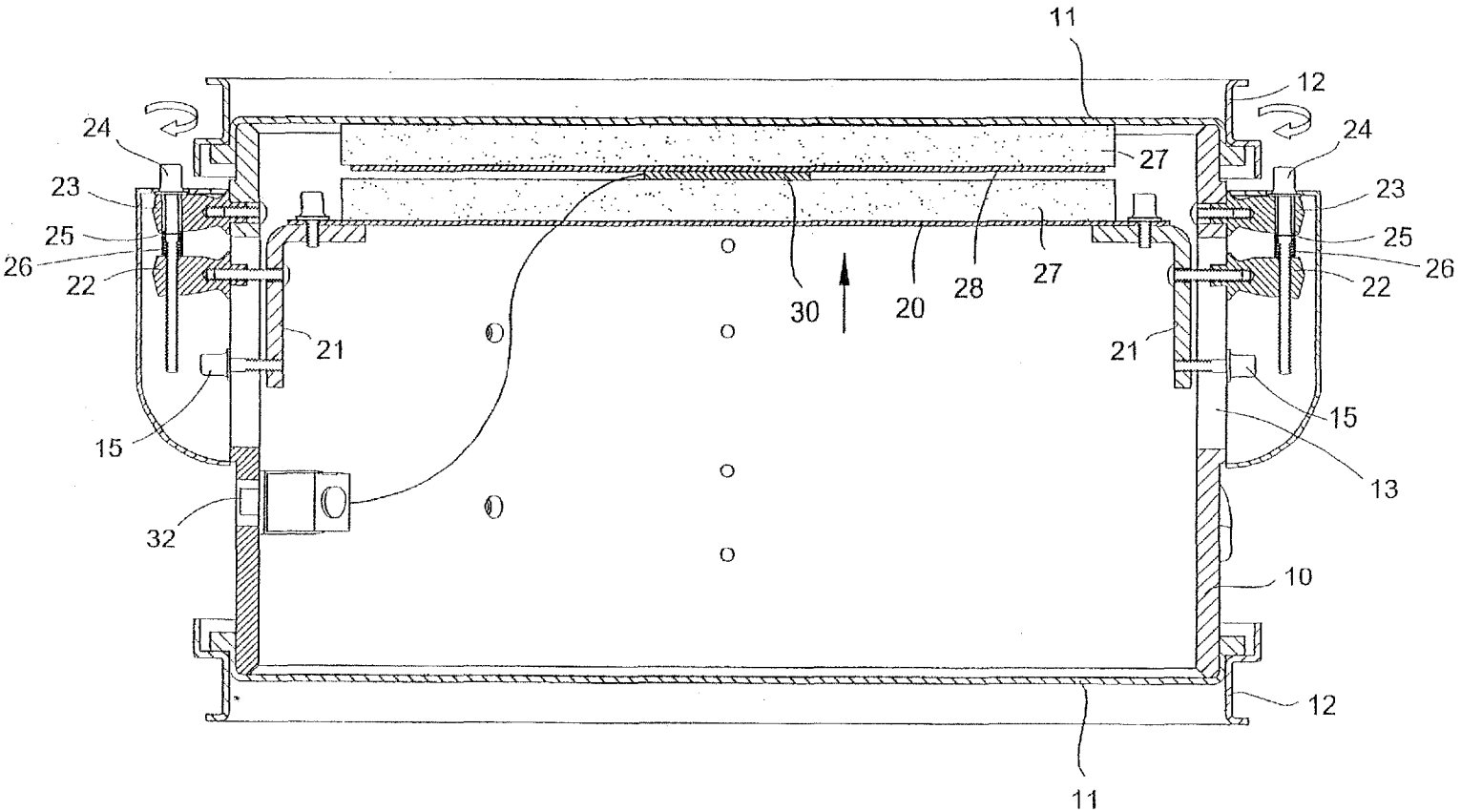
FIG. 4 is a cross-sectional view illustrating the drum of the present invention in a condition for serving as a practicing drum.
Figure 5:
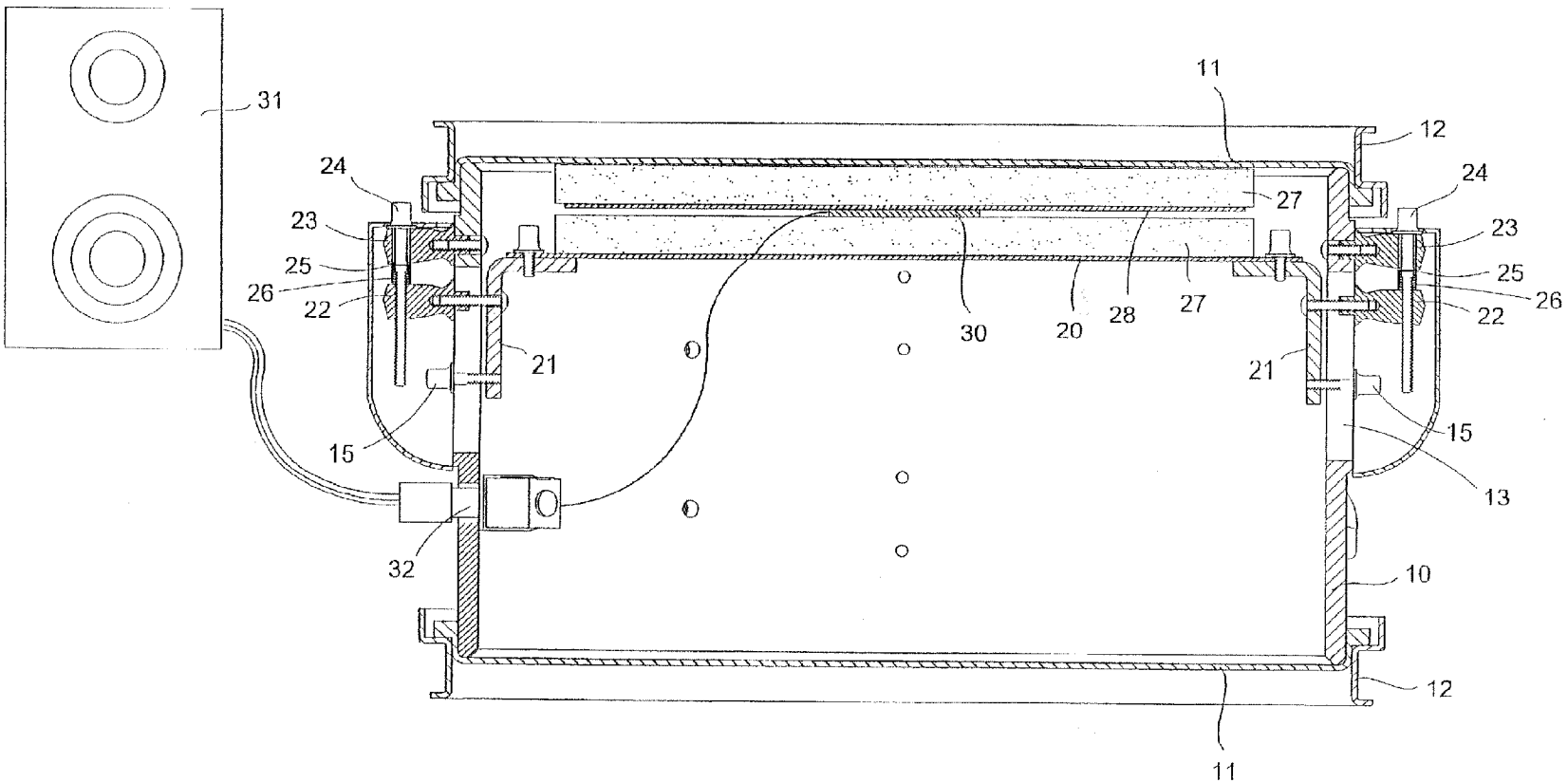
FIG. 5 is a cross-sectional view illustrating the drum of the present invention in a condition for serving as an electronic drum.

The present invention provides an improved structure of drum with multiple uses. As shown in FIGS. 1-3, the improved structure of drum according to the present invention comprises a shell (10), which has a configuration similar to the structure of a regular or conventional drum shell and has a hollow cylindrical configuration. The shell (10) has top and bottom opening ends each of which is covered by a skin (11) that is looped and fixed by a counterhoop (12) to present a complete outside configuration of the drum. The shell (10) has a side wall in opposite portions thereof aligned elongate holes (13) are respectively formed. A mounting hole (14) is formed in the side wall of the shell above each elongate hole (13) so as to be in vertically alignment with respect to the elongate hole (13). Arranged inside the shell (10) is a slidable base board (20), which has a board body having opposite ends respectively supported and retained by oppositely arranged support brackets (21) and further respectively retained and fixed by slidable rod seats (22) that are arranged outside the elongate hole (13) and extend through the elongate holes (13) and the support brackets (21), whereby the base board (20) is slidably movable in a vertical direction with a movement of the slidable rod seats (22) within and along the elongate holes (13). To prevent undesired rotation of the base board (20) during the slidable movement thereof, an auxiliary bar (15) is arranged at a portion below the retained connection between each support bracket (21) and the slidable rod seat (22) so as to be received in the respective elongate hole (13) in a manner of vertically opposing the slidable rod seat (22), thereby providing assistance for direction maintenance in the sliding movement. The mounting hole (14) located above the elongate hole (13) receives a fixed rod seat (23) extending therethrough and secured to the shell (10) to be vertically oppose the slidable rod seat (22). An adjustable threaded rod (24) in put, from the upper side, through the fixed rod seat (23) and is retained at a lower side of the fixed rod seat (23) by the retention ring (25), so that undesired separation of the threaded rod (24) is prevented. The threaded rod (24) that extends through the fixed rod seat (23) is further fit through an elastic member (26) in a manner of being circumferentially compassed thereby, so that the retention ring (25) may serve as a positioning end for the fitting arrangement of the elastic member (26) that engages the slidable rod seat (22). The elastic member (26) has a length that is the spacing distance between the rod seats (22, 23) that are assembled to oppose each other. With a lower end section of the threaded rod (24) extending through and fixed to a central internally-threaded hole defined in the slidable rod seat (22), applying a rotation operation to the threaded rod (24) may control the slidable rod seat (22) with the threading rotation as being guided by the elongate hole (13) through which the slidable rod seat extends to realize a process of stable vertical movement, and simultaneously moving the base board (20) arranged inside the shell (10) in the vertical direction for positional adjustment. Further, the base board (20) supports thereon upper and lower cushioning pads (27), which are sequentially stacked and interpose therebetween a sound collection board (28) to which a sound effect detection circuit board (30) is attached. Proper coupling is realized between the boards and the pads, so that they are vertically movable with the base board (20) for simultaneous adjustment of position. When the base board (20) is adjusted in such a way of sliding upward, the cushioning pad (27) of the top surface is set in contact engagement with the skin (11), as illustrated in FIG. 4. The top side cushioning pad (27), when set in engagement with the skin (11), is positioned against and thus forming a unitary combination with the skin (11), so that in percussion of the drum, a drumstick applies a force to the drum and the cushioning engagement realized with the cushioning pad (27) cushions the force, preventing the skin from generating loud sound, and only deep and low sound is generated. This provides an excellent condition for practicing drum percussion and allows easy practice to be done. Further, with the arrangement that the cushioning pad (27) is set in engagement with the skin (11), the direct contact with the skin (11) allows the sound to directly transmit to the sound collection board (28) that is interposed in the stack. The sound effect circuit board (30) attached to the sound collection board (28) is electrically connected through electrical wires to a socket (32) that is arranged on the circumferential side wall of the shell (10) for further electrical connection with an external electronic speaker (31) to convert the sound of striking the drum into electronic sound effect to be output with the electronic speaker (31) so as to realize the use as an electronic drum. When the threaded rods (24) on the opposite sides of the shell (10) are adjusted with a tool through revered rotation, the base board (20) is caused by the rotation to slide downward to have the cushioning pad (27) that was in engagement with the skin (11) to move downward therewith and thus separated from the skin (11), whereby the skin (11) shows a floating condition as being no longer supported by the pad, as illustrated in FIG. 2. When the drum is struck under this condition, the skin (11) generates sounds as regular drum percussion. In this way, the drum according to the present invention provides a drum that allows of switching between different modes of use as desired with a single drum structure. This allows a user to have the convenience of multiple uses in drum percussion.

Further, with the improved structure of drum according to the present invention, a slidable base board (20) is arranged inside a drum shell and the base board (20) carries thereon cushioning pads (27) and a sound collection board (28) that are sequentially stacked to collectively form a structure that is movable for adjusting drum percussion sound effect. With rotation in different direction to realize control, threaded rods (24) that are externally arranged on opposite sides of the shell (10), the slidable rod seat (22) is controlled to do vertical movement simultaneously with the rotation of the threaded rods (24). As to the control operation of the threaded rods (24), the threaded rods (24) that are located on the opposite sides can be simultaneously rotated for controlling and retaining purposes so as to realize almost identical ascending/descending displacement. This provides a major feature of adjusting the position of the cushioning pad (27) that is carried by the base board (20) to selectively engage with or disengage from the skin (11) in order to realize switching to a desired mode, so that a single drum can serve as a drum for practicing or a drum for regular performance, or alternatively serving as an electronic drum that is operable through connection with an electrical power supply. As such, a single drum shows switchability among multiple uses. In view of such a structure, the drum of the present invention is novel with respect to the known drum structures and may provide significant convenience of use that is of no match among the known drum structure. Thus, in view of the characteristics of easy structural switching for multiple uses, the present invention provides a completely novel breakthrough for the structure of drum.

In summary, the present invention provides an improved structure of drum with multiple uses, which comprises a shell slidably receiving therein a vertically position adjustable base board that carries thereon a stacked arrangement of a sound collection board and cushioning pads. Through a simple operation of fixing and controlling performed on adjustable threaded rods arranged at opposite sides, vertical movement of the base board is carried out to simultaneously realize ascending/descending and switchable engagement of the cushioning pads with the skin. Further, through electrical connection between a circuit board of an electronic sound collection board and an electronic speaker and supplying of electrical power thereto, a further use of serving as an electronic drum is realized. As such, a single drum provides various modes of percussion and operation. Such a novel structure was not found in any known drum and the convenience of switching among different ways of use and adjustment are apparently patentable over any known structure of drum.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A structure of drum of multiple uses comprising a shell for the assembling of the drum having upper and lower ends each covered by a skin, and a counterhoop looping and securing each of the skins; characterized in that the shell has a hollow interior space receiving therein a base board that is slidable for selectively ascending and descending, the base board carrying thereon a stacked arrangement of cushioning pads that sandwich a sound collection board from upper and lower sides thereof, the sound collection board comprising a sound effect detection circuit board attached thereto, the base board having two sides that are respectively supported and retained by slidable rod seats through support brackets so as to cooperate with elongate holes defined in the shell for being guided thereby, an adjustable threaded rod being put from an upper side through a fixed rod seat to screw to a threaded hole of each of the slidable rod seats so as to perform rotation that controls vertical movement of the base board inside the shell for position adjustment that allows the cushioning pad carried on the base board to switch between being set in engagement with the skin and being separated from the skin, whereby multiple uses of being a regular drum, a practicing drum, and an electronic drum can be selectively performed.

2. The structure of drum of multiple uses according to claim 1, wherein each of the threaded rods receives an elastic member circumferentially compassing a portion thereof between the fixed rod seat and the slidable rod seat.

3. The structure of drum of multiple uses according to claim 1, wherein each of the threaded rods extends through the fixed rod seat below which a retention ring is provided to retain the thread rod in position.

4. The structure of drum of multiple uses according to claim 1, wherein an auxiliary bar is arranged below retained connection between each of the support brackets on the opposite sides of the base board and the slidable rod seat to provide assistance for maintaining direction in sliding movement.

5. The structure of drum of multiple uses according to claim 1, wherein the cushioning pad is set in engagement with the skin when the base board is moved upward with rotations of the threaded rods on the two sides so as to serve as a practicing drum.

6. The structure of drum of multiple uses according to claim 1, wherein the circuit board of the sound collection board is electrically connected through electrical wires to a socket arranged on a circumference of the shell for selective connection with an electronic speaker so as to serve as an electronic drum.

* * * * *